US006659709B1

(12) United States Patent
Anderson

(10) Patent No.: US 6,659,709 B1
(45) Date of Patent: Dec. 9, 2003

(54) TOOL CARRIER ATTACHMENT FOR EXCAVATOR

(76) Inventor: Oscar D. Anderson, HC-01, Box 358, Naples, ID (US) 83847

( * ) Notice: Subject to any disclaimer, the term of this patent is extended or adjusted under 35 U.S.C. 154(b) by 4 days.

(21) Appl. No.: 09/643,093

(22) Filed: Aug. 21, 2000

(51) Int. Cl.[7] ..... B66C 1/42

(52) U.S. Cl. ..... 414/729; 414/724; 414/912; 37/403

(58) Field of Search ..... 414/729, 724, 414/686, 912; 37/403, 903

(56) References Cited

U.S. PATENT DOCUMENTS

| | | | | | |
|---|---|---|---|---|---|
| 3,243,066 | A | * | 3/1966 | Gardner et al. | 414/723 |
| 3,666,124 | A | | 5/1972 | Arnold | 214/138 |
| 3,999,582 | A | | 12/1976 | Allen et al. | 144/3 D |
| 4,100,688 | A | * | 7/1978 | Grist | 414/912 X |
| RE30,769 | E | | 10/1981 | Cobb et al. | 299/67 |
| 4,355,670 | A | | 10/1982 | Ohrberg et al. | 144/34 R |
| 4,669,947 | A | | 6/1987 | Frost | 414/724 |
| 4,720,234 | A | * | 1/1988 | Stralow | 414/686 |
| 4,884,641 | A | * | 12/1989 | Kendall | 414/724 X |
| 5,101,872 | A | | 4/1992 | Scheuren | 144/3 D |
| 5,355,918 | A | | 10/1994 | Lang | 144/2 N |
| 5,373,652 | A | | 12/1994 | Olsson | 37/403 |
| 5,472,308 | A | | 12/1995 | Somero | 414/724 |
| 5,544,435 | A | | 8/1996 | Somero | 37/405 |
| 5,553,408 | A | | 9/1996 | Townsend | 37/406 |
| 5,590,482 | A | | 1/1997 | Peterson et al. | 37/403 |
| 5,628,130 | A | | 5/1997 | Desrochers | 37/444 |
| 5,678,332 | A | | 10/1997 | Hawkins | 37/403 |
| 5,727,610 | A | | 3/1998 | Isley | 144/4.1 |
| 5,813,822 | A | | 9/1998 | Pisco | 414/723 |
| 5,964,050 | A | | 10/1999 | Svahn | 37/409 |

* cited by examiner

*Primary Examiner*—Donald W. Underwood
(74) *Attorney, Agent, or Firm*—Seed IP Law Group PLLC

(57) ABSTRACT

Mobile construction equipment includes a hydraulically activated boom and operating stick for carrying two separately mounted construction tools. In an excavator, a bucket is mounted on the end of the stick in the conventional manner and adjacent the bucket there is rotatably mounted a second tool carrier or rack having an inner and outer end. Detachably mounted at the outer end of the rack is the second tool which travels with the mobile construction equipment. The rack is rotatable from a retracted position extending upwardly and along the stick to an extended position where the tool can be deployed for operational use.

1 Claim, 6 Drawing Sheets

TOOL CARRIER ATTACHMENT FOR EXCAVATOR

TECHNICAL FIELD

This invention relates to tools for use on mobile construction equipment such as excavators.

BACKGROUND OF THE INVENTION

One of the more common pieces of powered equipment used in construction projects, logging operations, road building operations and the like is the mobile excavator typically having a rotatable cab containing the power unit mounted on wheels or caterpillar-like tracks. Extending upwardly and rotatable with the cab is the angled large boom member which can be moved up and down by actuating cylinders. Mounted at the upper end of the boom is the excavator stick member which can be pivoted in an up and down motion about the end of the boom by an actuating cylinder mounted on the boom. Mounted on the lower end of the excavator stick typically will be a single tool; most commonly an excavator bucket which is pivotally mounted and rotatable by way of an actuating cylinder connected to a linkage assembly. These machines have been commercially available for many years from manufacturers such as Caterpillar Tractor.

Typically these machines are most often operated with the bucket mounted at the end of the stick, it being a versatile implement for digging soil, scarifying the ground, and smoothing the ground. Other well-known tools can be mounted on the end of the stick as the need arises if a particular task must be performed. For example, in a logging operation where it is common for tasks to include road construction, brush clearing and timber harvesting, different functional tools will be used. Traditionally, for example, when an excavator is to be utilized for harvesting timber the excavator bucket would be removed and, with a typical coupling mechanism, a tree-felling head would be mounted on the end of the excavator stick. Again, such assemblies are well known and commercially available to permit multiple uses by the mobile excavator.

Oftentimes when in actual use where the excavator would be performing multiple functions, it was common to remove the bucket, attach the needed tool (such as a felling head, harvester-head, log grapple, brush cutter, or the like), and thereafter perform the particular task. Once the particular task was performed and the bucket needed again, additional time was needed to remove the attached tool and reinstall the bucket. This process is time consuming and reduces the productivity of the excavator.

When an excavator is used in the woods, the tool that was removed could be left a great distance from where the task was completed utilizing the second tool then attached to the stick. Such being the case, the mobile excavator would then have to return to the site where the first tool was left, taking even more time. Oftentimes, the tool could not be readily located and additional time was lost searching for it.

Since the bucket is the commonly used tool on the end of the stick it became apparent that what was needed was a rack assembly for carrying a second tool on the end of the stick which could be mounted so as to not interfere with the functioning of the bucket but which could be readily deployed when needed.

SUMMARY OF THE INVENTION

This invention is a tool carrier attachment or rack mounted adjacent the primary tool on the end of an excavator stick for carrying a second tool while the excavator is being operated. The rack is an elongated frame pivotally mounted on the stick and rotates in the same plane as the primary tool. At the distal end of the frame there is provided a tool mounting station adapted to support and carry a selected second tool. Means are provided for rotating the frame from a retracted position extending upwardly and opposite the boom stick to an extended position where the rack extends downwardly from the end of the stick. When the rack is in the retracted position the attached tool may be held in place while main the excavator tool is used as the primary operating tool. When the rack is in its extended position the attached tool can be deployed for operational use.

DETAILED DESCRIPTION OF THE INVENTION

Figure 1:
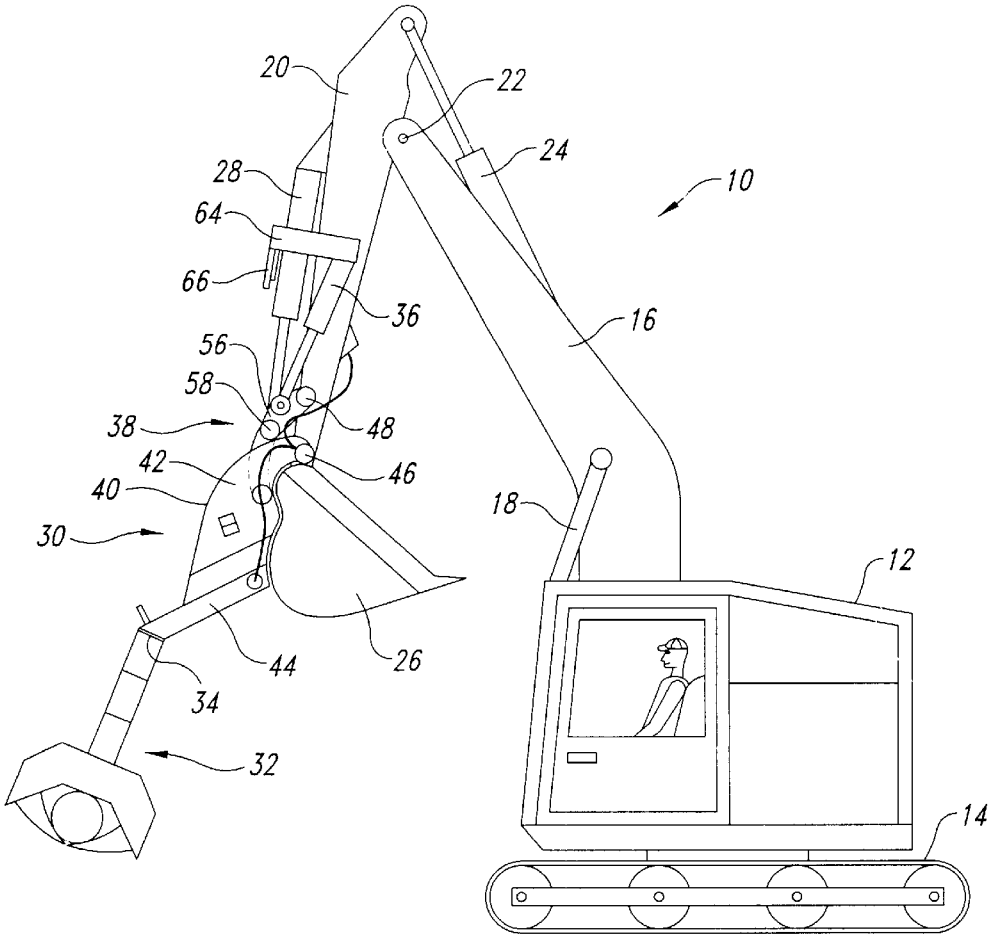
FIG. 1 is a side elevation view of a typical mobile excavator having the present invention mounted on the end of the boom stick.
Figure 2:
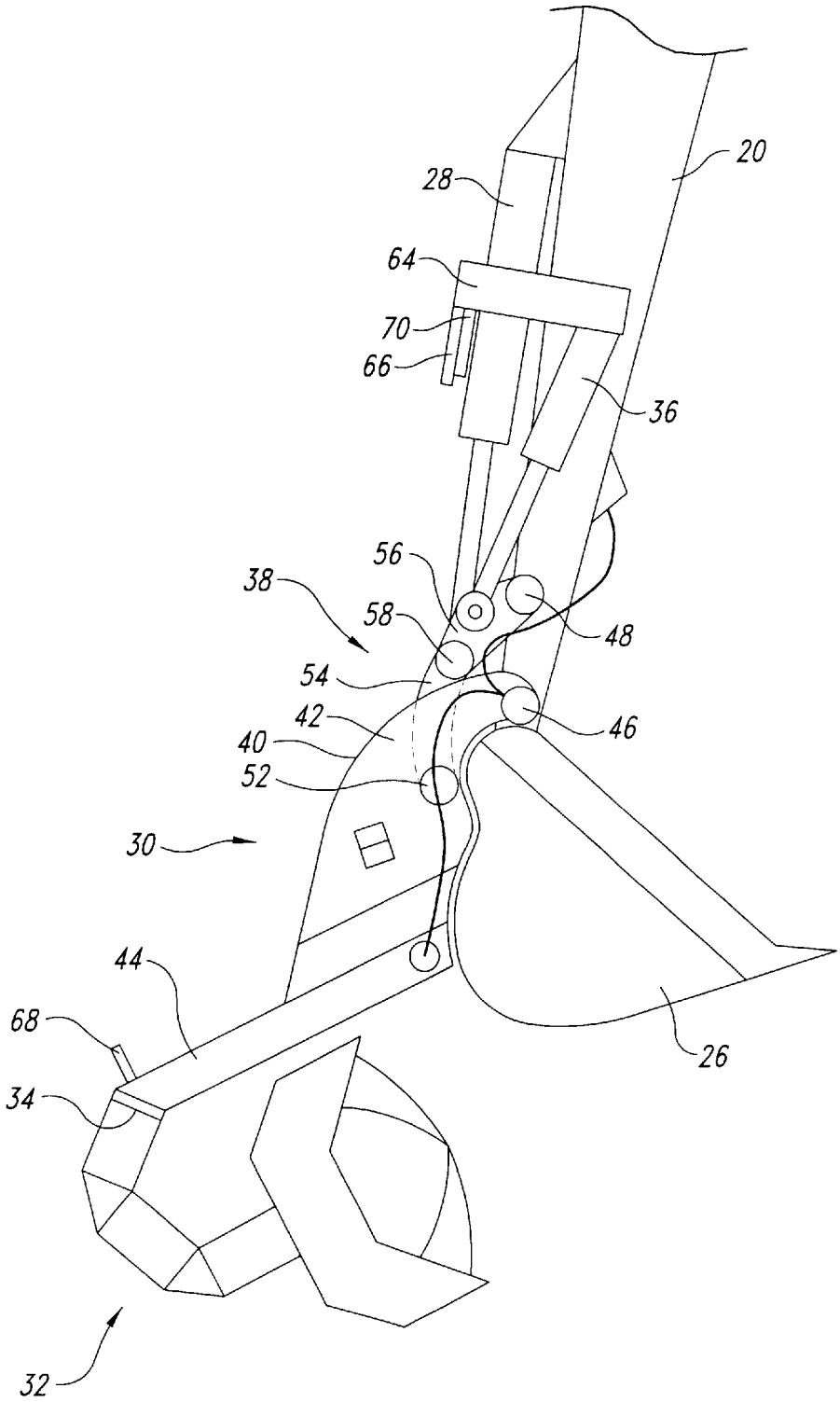
FIG. 2 is also a side elevation view showing the bucket and tool rack with its attached tool mounted on the end of the stick.
Figure 3:
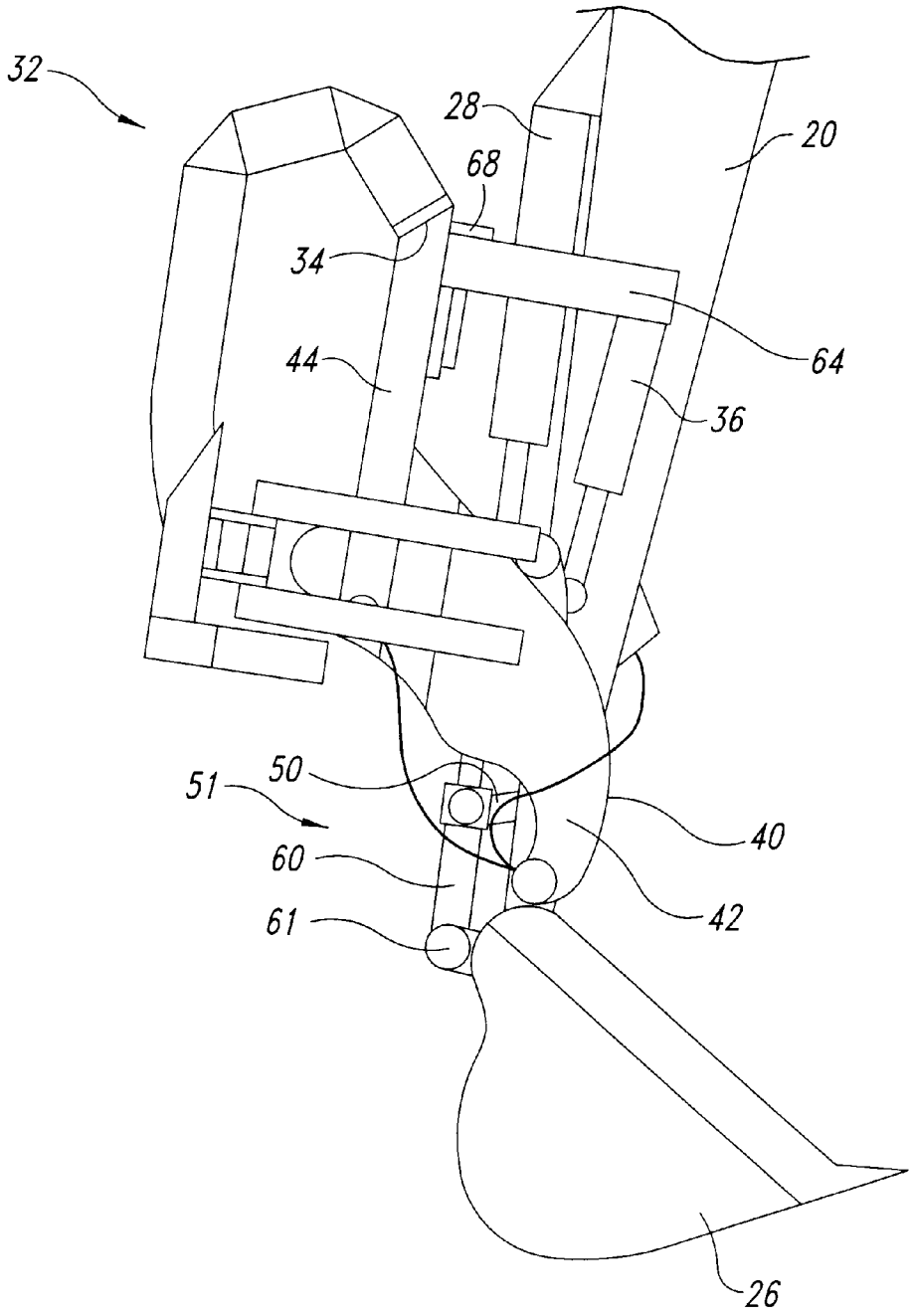
FIG. 3 is another side elevation view showing the tool rack and tool in the retracted position.

Referring first to FIGS. 1–3, a typical commercially available excavator is generally indicated at 10. Excavator 10 has a swivel-mounted cab 12 atop movable tread assemblies 14. Extending upwardly from cab 12 is the boom assembly 16 which is moved through its normal range of motion by actuating cylinder 18. At the top of boom 16 and extending downwardly therefrom is the hydraulically operated stick assembly 20. Serving to move stick assembly 20 through its normal range of movement about pinned connection point 22 is actuating cylinder 24. Stick assembly 20 is typical in that it is a box beam construction and has a pivotally mounted primary tool or rotatable bucket 26 attached at its outer end in the normal manner. Serving to rotate the bucket through its usual range of motion is hydraulic actuating cylinder 28 located on stick 20 in its common location along the top side of the stick.

Pivotably mounted at the outer end of stick 20 is an elongated rotatable carrier or rack generally indicated at 30. Rack 30 is provided to support and carry a second tool generally indicated at 32 when excavator 10 is being used. A suitable connecting member 34 is interposed between rack 30 and tool 32. In the embodiment depicted, a typical commercially available tree felling head is attached to rack 30 by way of a commercially available connecting member 34. Difference types of connecting members may be utilized depending upon the particular type of second tool and they will preferably permit quick connections and disconnections to be made.

Rack 30 is rotated through its range of motion in substantially the same plane as bucket 26 by a pair of hydraulic cylinders, each indicated at 36 on either side of stick 20, and each connected at its outer end to a linkage generally indicated at 38. In the preferred embodiment, rack 30 has a body portion 40 comprising two opposed sidewalls each indicated at 42 and an outwardly extending beam member 44 attached to the ends of the sidewalls, at the end of which is attached connecting member 34 and the selected second tool.

At the inner ends of sidewalls 42, rack 30 is connected to the end of stick 20 by the use of pins 46 which project outwardly from stick 20 and are typical of pins used for pinning a bucket onto the end of a stick except they are lengthened to serve as the pivotal attachment means for rack 30 as well as for bucket 26. As previously noted, rack 30 can be rotated about pins 46 by cylinders 36 acting through linkages 38 from an extended position, such as shown in FIG. 2, to a fully retracted position such as shown in FIG. 3. Linkages 38 are typical of a four-point linkage assembly and in the preferred embodiment include a second lengthened pin 48 on stick 20 spaced from pin 46. Pins 48 also serve to connect stabilizing arms 50 to the stick assembly 20. Spaced above pins 46 in sidewalls 42 are pinned connections 52 which serve to support linkage arms 54 for pivotal movement and to cause the rotational movement of rack 30. Extending upwardly from pins 48 are pivotally mounted straps 56 to which, at approximately their midpoints, are pivotally attached the outer ends of cylinders 36. At the end of straps 56, at pin connection 58, is the opposing end of arm 54, the other end of which, as noted, is pinned to the rack sidewall.

Figure 4:
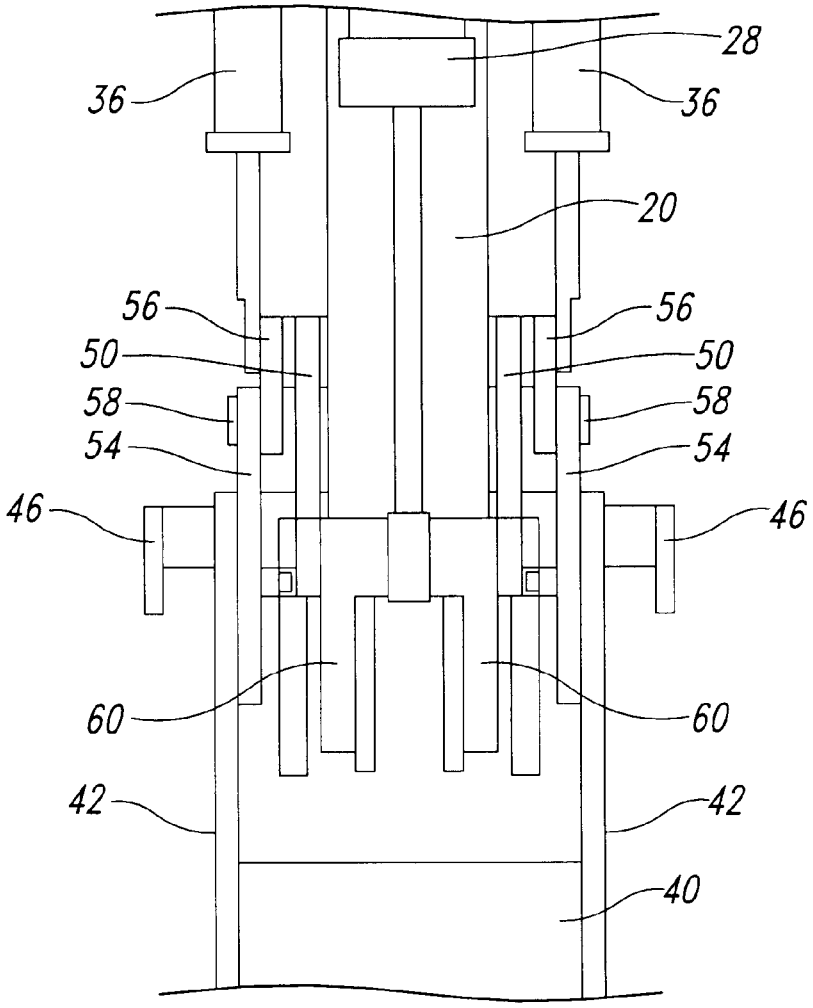
FIG. 4 is a front elevation view illustrating the attachment and linkage structure for the rack at its inner end adjacent to the bucket.
Figure 5:
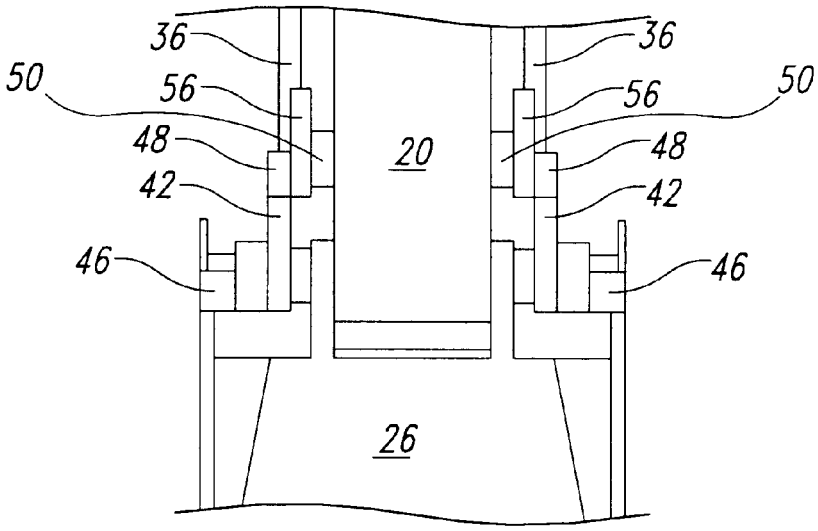
FIG. 5 is a rear elevation view showing the connecting and linkage structure for the rack.

Turning now to FIGS. 4 and 5, the lateral arrangement of the rack and bucket components in relation to stick 20 may be better seen and understood. The linkages 38 for operating the rack are closely spaced on the outside of the existing linkage for bucket 26 and inside sidewalls 42. Bucket linkage assembly 51 further includes the rod-end of cylinder 28 being pinned to a turning arm 60 which is connected to the backside of bucket 26 at pinned connection 61 (see FIG. 3). As will be readily apparent to those skilled in the art the rack size will be adjusted to fit the particular dimensions of the excavator model on which the rack is mounted as well as the particular type of attached tool.

It will be recognized that a hydraulic and electrical power system will be provided along with a control system to give the operator in cab 12 the ability to control associated valving and operating sequences for movements of the cab, boom, stick, bucket, tool rack, and attached tools. Such systems are well known and can be modified by those with ordinary skill in the art to provide the hydraulics and controls for operation of the present invention.

Figure 6:
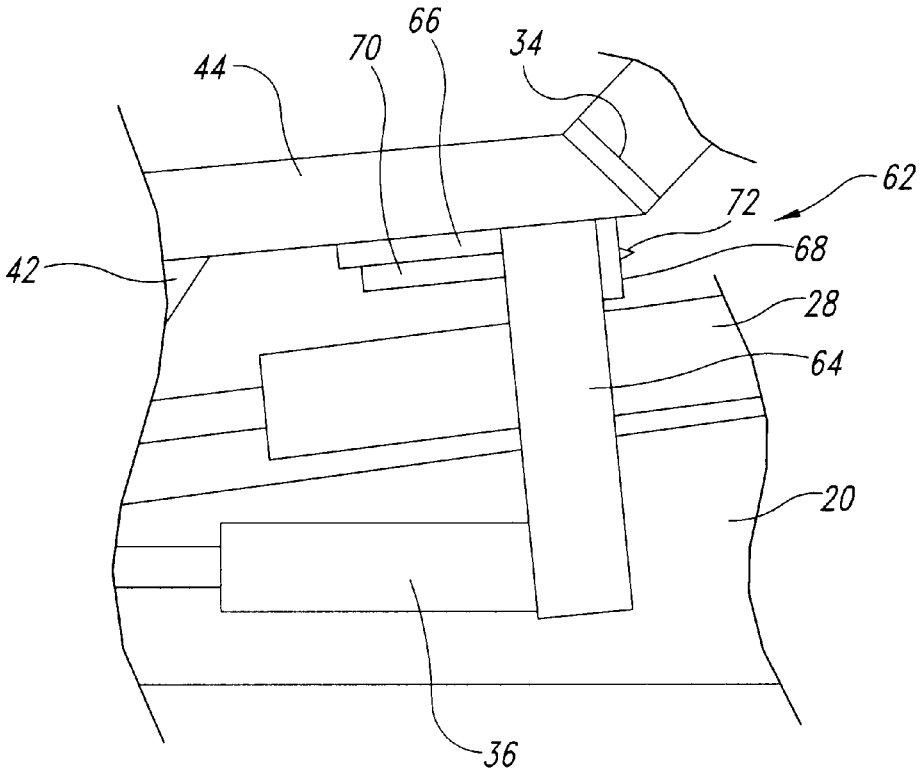
FIG. 6 is a side view illustrating the locking mechanism for holding the rack and tool in place when in the retracted position.

Turning now to FIG. 6, the rack locking mechanism generally indicated at 62 will be described. Locking mechanism 62 is supported on a bracket 64 which is fixed to the side of the stick and extends roughly perpendicular thereto upwardly from a point adjacent to where the cylinders 36 are mounted. Bracket 64 straddles actuating cylinder 28 and has a platform 66 at the top. When rack 30 is in the retracted position, an outer portion of beam member 44 will rest atop platform 66. A locking tab 68 is mounted on the end of the beam and extends downwardly therefrom at a location where it will overlay an edge of platform 66. A small hydraulic cylinder 70 is mounted to the underside of platform 66 substantially in line with an aperture positioned within locking tab 68. To lock the tool rack in place against stick 20 the operator activates hydraulic cylinder 70 causing a locking pin 72 on the end of the rod to extend into the aperture to lock the rack in place. When the tool rack is to be released for deployment, the hydraulic cylinder will retract pin 72, thereby releasing the rack.

The operation of the present invention is very straightforward. In one preferred embodiment, a typical excavator will have a regular bucket mounted on the end of the stick. It is rotatable about the same axis as rack 30 as just described and is used for scooping dirt and the like. A preselected tool is mounted on the end of rack 30 and when the bucket is in use, the tool and rack will be rotated upwardly to a position out of the way and removed from the bucket. When necessary for travel and the like, the rack 30 can be locked in place in its retracted position. In addition, if the tool has grapple arms or the like which extend far enough they can be rotated inwardly so as to grip some part of the rack body so the tool is further held in place relative to the rack.

In the embodiment depicted, the rack mounted tool is a commercially available felling head and it can be utilized with the bucket, for example, for tree clearing and road building in forested areas. If the excavator operator first wishes to fall some timber, he will cause the bucket to be rotated upwardly toward the cab to a position out of the way of the tool rack as it is being deployed downwardly by actuating cylinders 36. In FIG. 1, the operator has deployed the tool and rack downwardly to an extended operating position, and the tool has been released from the rack to be controlled by its the operator to perform its function. A feature in the preferred embodiment is illustrated in FIG. 1 where the bottom edge of rack 30 is contoured to fit the rear surface contour on the bucket. As will be understood, when the rack is deployed and the contoured shape of the rack nests within the contoured shape on the bucket, additional stability can be provided during operation. In the tree felling application, the felling head will be operated to cut and fall timber until such time as enough cleared area is established for road building. At that point the operator will retract the rack at least partially to a position out of the way of the bucket where it can be held in place hydraulically or, if the bucket is to be used for a lengthy period, the rack can be locked firmly in place utilizing locking mechanism 62. The bucket is then utilized as the primary tool while the secondary, but still attached, tool is retracted and out of the way. This process can be repeated until the task is complete. Having an excavator with both tools traveling with it and each being operational upon command reduces changeover time and also keeps both tools together on the machine.

Having provided a description of a preferred embodiment many changes, alternatives, and variations may occur to those skilled in the art. All such changes and variations are intended to be included within the scope of the claims.

What is claimed is:

1. A device comprising:

an articulated assembly, having a boom and a stick, the boom and stick being joined at respective first ends, and being rotatable with respect to each other around a common joint;

a first tool, affixed to a second end of the stick, and rotatable, with respect to the stick, around a pivot point;

a rack for attaching a second tool, having first and second ends, affixed at the first end to the stick, adjacent to the first tool, rotatable around the pivot point, and having a range of motion around the pivot point that enable the rack to lie, at a first extreme, against the stick, and to extend, at a second extreme, away from the stick, the second end of the rack being configured to attach the second tool;

a bracket attached to the rack having an aperture in a position where it may be engaged by a locking assembly when the rack is at the first extreme of its range of motion; and the locking assembly coupled to the stick, the relative positions of the locking assembly on the stick, and the bracket on the rack, being selected such, that when the rack is rotated to the first extreme of its range of motion, the bracket is in close proximity to the locking assembly, which can engage the bracket to lock the rack into a defined, stable position, the locking assembly including:

a cylinder coupled to the stick;

a locking pin for engaging the bracket, positioned within the cylinder, having a first end and a second end, having a retracted position in which the locking pin does not engage the bracket, and an extended position in which the first end of the locking pin extends from the cylinder and engages the bracket, and wherein the first end of the locking pin is tapered, and the angle of the taper is selected such, that as the locking pin extends to the extended position, it engages the aperture of the bracket, and draws the rack tighter to the defined, stable position; and means for moving the piston from the retracted position to the extended position, and for moving the piston from the extended position to the retracted position.

* * * * *